US007822376B2

(12) United States Patent
Nagano

(10) Patent No.: US 7,822,376 B2
(45) Date of Patent: Oct. 26, 2010

(54) SHEET FEEDER AND COPYING MACHINE INCLUDING THE SAME

(75) Inventor: Yusuke Nagano, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 602 days.

(21) Appl. No.: 11/773,521

(22) Filed: Jul. 5, 2007

(65) Prior Publication Data

US 2008/0008506 A1 Jan. 10, 2008

(30) Foreign Application Priority Data

Jul. 7, 2006 (JP) ..... 2006-188314

(51) Int. Cl.
*B65H 7/12* (2006.01)

(52) U.S. Cl. ..... 399/367; 399/18; 399/388

(58) Field of Classification Search ..... 399/18, 399/367, 388

See application file for complete search history.

(56) References Cited

U.S. PATENT DOCUMENTS 4,873,547 A * 10/1989 Sasaki et al. ..... 399/402
5,131,648 A * 7/1992 Ito ..... 271/262
2005/0127597 A1* 6/2005 Sano et al. ..... 271/258.01
2005/0228535 A1* 10/2005 Simonis et al. ..... 700/228

FOREIGN PATENT DOCUMENTS

JP 09-142699 6/1997

* cited by examiner

*Primary Examiner*—Judy Nguyen
*Assistant Examiner*—Jennifer Simmons
(74) *Attorney, Agent, or Firm*—Renner, Otto, Boisselle & Sklar, LLP

(57) ABSTRACT

A sheet feeder includes: a sheet-length detection member for detecting a length of a sheet; a transfer-length detection member for detecting a transfer length of the sheet; a double-feed detection member for detecting double feed of the sheets when the sheets are transferred while being overlapped with one another; and a control member for controlling the sheet-length detection member, the transfer-length detection member and the double-feed detection member; wherein the control member determines that double feed of the sheets has occurred, when the transfer length of the sheet is greater than the length of the sheet and a length obtained by subtracting a difference between the transfer length of the sheet and the length of the sheet from the length of the sheet is substantially equal to a double-feed length detected by the double-feed detection member.

6 Claims, 12 Drawing Sheets

SHEET FEEDER AND COPYING MACHINE INCLUDING THE SAME

CROSS-REFERENCE TO RELATED APPLICATIONS

This application is related to Japanese patent application No. 2006-188314 filed on Jul. 7, 2006, whose priority is claimed under 35 USC §119, the disclosure of which is incorporated by reference in its entirety.

BACKGROUND OF THE INVENTION

1. Field of the Invention

The present invention relates to a sheet feeder and a copying machine including the same and, more particularly, relates to a sheet feeder having a double-feed detecting function for detecting sheets being transferred while being overlapped with one another.

2. Description of Related Art

As a prior art relating to the present invention, there have been known a double-feed detecting apparatus which include a sheet-length detection device for measuring sheet-length being transferred in a transfer direction and a sheet-thickness detection device for measuring sheet-thickness, wherein the sheet thickness detection device measures the sheet-thickness in vicinity of a middle of the sheet-length measured by the sheet-length detection device, thereby enabling certainly detecting double feed of sheets, even though the sheets are misaligned in the feeding direction and overlapped with one another (see for example, Japanese Unexamined Patent Publication No. HEI 9(1997)-142699).

In recent years, among image forming apparatus such as copying machines, image forming apparatus which include an auto document feeder (hereinafter, abbreviated to an "ADF") for automatically feeding sheets to an image reading portion thereof have become a mainstream.

Such an ADF transfers sheets, one by one, from a stack of sheets placed on a sheet tray to a sheet transfer path and further transfers them to the image reading portion of the image forming apparatus.

Among these ADFs, there are some ADFs which have a function of detecting double feed of sheets, in order to prevent sheets from being transferred to the sheet transfer path at double-feed states where the sheets are overlapped with one another to cause incorrect reading of images intended to be read, thus resulting in improper printing inconsistent with user's requests and malfunctions such as page dropouts.

Exemplary means for detecting double feed of sheets are methods which utilize an optical sensor or an ultrasonic wave sensor provided in the sheet transfer path.

With such a method which utilizes an optical sensor, change of a quantity of light generated from a light generating device is detected with the optical sensor when the light passes through sheets, and a comparison is made between the light quantity change and a predetermined threshold value to determine whether sheets are being transferred normally one by one or being transferred at a double-feed state.

On the other hand, with such a method which utilizes an ultrasonic wave sensor, utilizing a fact that an ultrasonic wave generated from a wave generating device is attenuated by sheets when it is passed through the sheets, a comparison is made between a degree of attenuation of the ultrasonic wave received by a wave receiving device and a predetermined threshold value to determine whether the sheets are transferred normally one by one or transferred at a double-feed state.

Further, there is a possibility that the stack of sheets placed on the sheet tray of the ADF contains sheets on which labels are partially attached or sheets on which cutout paper pieces are partially attached.

In this case, with the method utilizing an optical sensor, the quantity of light passed through sheets is decreased to above the predetermined threshold value at portions of sheets to which such labels or paper pieces are attached, thereby inducing false detection of double feed, even though sheets are normally transferred one by one.

Further, even with the method utilizing an ultrasonic wave sensor, similarly to with the method utilizing an optical sensor, the degree of attenuation of the ultrasonic wave is increased to above the predetermined threshold value at portions of sheets to which labels or paper pieces are attached, thereby inducing false detection of double feed.

SUMMARY OF THE INVENTION

The present invention has been made in view of the aforementioned circumstances and aims at providing a sheet feeder, an automated document feeder and reader including the same and a copying machine which are capable of preventing false detection of double feed, even if a stack of sheets contains sheets on which labels or paper pieces are attached.

According to the present invention, there is provided a sheet feeder, which comprises: a sheet-length detection member for detecting a length of a sheet; a transfer-length detection member for detecting a transfer length of the sheet; a double-feed detection member for detecting double feed of the sheets when the sheets are transferred while being overlapped with one another; and a control member for controlling the sheet-length detection member, the transfer-length detection member and the double-feed detection member; wherein the control member determines that double feed of sheets has occurred, when the transfer length of the sheet is greater than the length of the sheet and a length obtained by subtracting a difference between the transfer length of the sheet and the length of the sheet from the length of the sheet is substantially equal to a double-feed length detected by the double-feed detection member.

According to the present invention, it is determined that double feed of sheets has occurred, only if the transfer length of the sheet is greater than the sheet length and a length obtained by subtracting the difference between the transfer length of the sheet and the sheet length from the length of the sheet is substantially equal to a double-feed length.

Namely, the length obtained by subtracting the difference between the transfer length and the sheet length from the sheet length is a double-feed length determined on the basis of the transfer length, which is an actual length. Unless this double-feed length agrees with a double-feed length detected by the double-feed detection member, it is determined that no double feed of documents has occurred, since it is determined that false detection of double feed occurs due to a label, a paper piece or the like attached thereto.

Accordingly, it is possible to prevent false detection of double feed, even if the stack of sheets contains sheets on which labels or paper pieces are attached.

DESCRIPTION OF THE PREFERRED EMBODIMENTS

Figure 1:
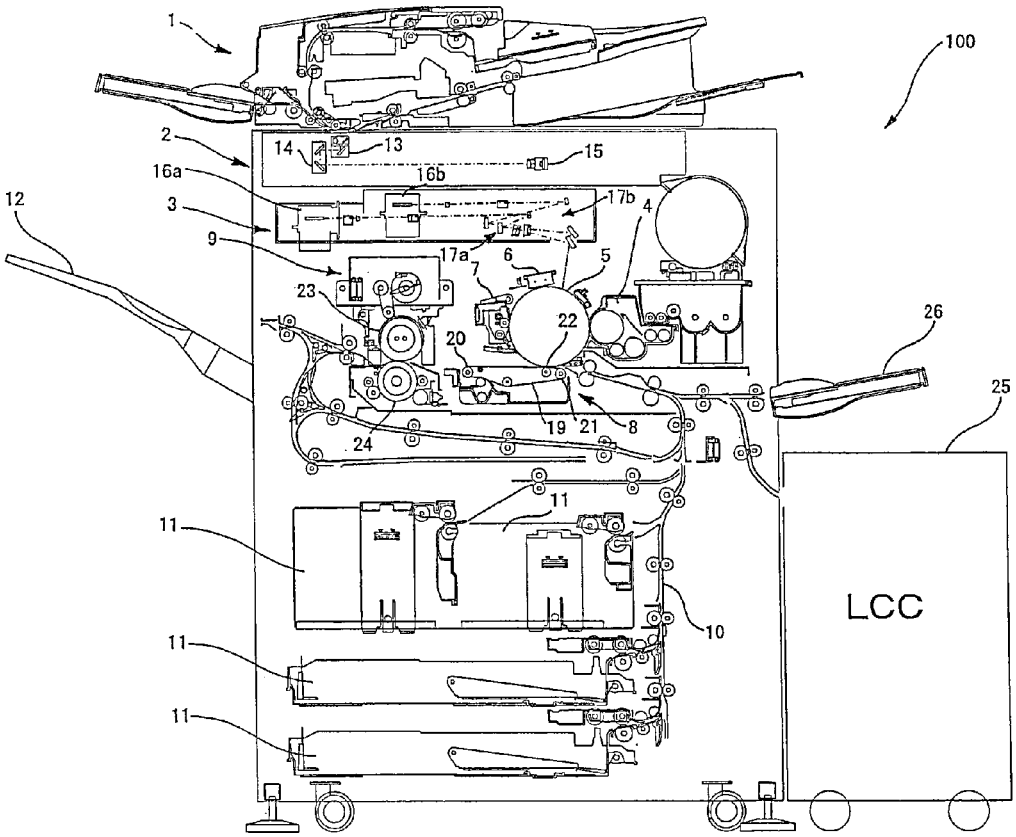
FIG. 1 is a schematic view illustrating an entire structure of an image forming apparatus incorporating an ADF (auto document feeder) according to an embodiment of the present invention.

A sheet feeder according to the present invention comprises: a sheet-length detection member for detecting a length of a sheet; a transfer-length detection member for detecting a transfer length of the sheet; a double-feed detection member for detecting double feed of the sheets when the sheets are transferred while being overlapped with one another, and a control member for controlling the sheet-length detection member, the transfer-length detection member and the double-feed detection member; wherein the control member determines that double feed of a sheet has occurred, when the transfer length of the sheet is greater than the length of the sheet and a length obtained by subtracting a difference between the transfer length of the sheet and the length of the sheet from the length of the sheet is substantially equal to a double-feed length detected by the double-feed detection member.

In the sheet feeder according to the present invention, "sheets" refer to documents on which images to be read are formed, OHP sheets, recording paper sheets, and the like.

The sheet-length detection member for detecting the length of the sheet refers to a member for detecting the length of the sheet in a transfer direction.

For example, the sheet-length detection member may be a member which comprises sheet-width restriction plates which are provided on a sheet tray in the sheet feeder and function as a sheet-width sensor, and plural sensors which are protruded from the sheet tray along a sheet longitudinal direction, whereby a size of documents placed on the sheet tray is estimated out of pre-stored plural types of typical sizes.

Further, in a case where sheets have non-standardized sizes, the aforementioned sheet-width sensor and a double-feed detection sensor which will be described later may be employed in combination to determine the sizes of sheets.

The transfer-length detection member for detecting the transfer length of the sheet refers to a member for detecting an actual transfer distance of a sheet being transferred along the transfer path.

For example, the transfer-length detection portion may be a member installed in the transfer path for detecting a passage of a sheet, such as a sheet passage sensor which displaces if it physically comes into contact with sheets being transferred therethrough, an optical sensor constituted by a pair of a light-emission device and a light reception device, and an ultrasonic wave sensor including a pair of a wave generating device and a wave receiving device.

Since a sheet passage time period is determined by the aforementioned sensor, the actual transfer length of the sheet in the transfer path can be detected from a product of a sheet transfer speed, which is naturally determined from a rotation speed of a transfer roller, and the aforementioned passage time period.

The double-feed detection member for detecting the double feed of the sheets refers to a member for detecting sheets being transferred while being overlapped with one another, namely double feed.

For example, the double-feed detection member may be an ultrasonic wave sensor including a pair of a wave generating device and a wave receiving device, an optical sensor including a pair of a light-emission device and a light reception device, a mechanical displacement detection sensor which slides on and contacts with a surface of a document being transferred therethrough, thereby being displaced by a thickness of the document, and the like.

A double-feed length of a sheet in the transfer path can be determined from a product of the time period during which the double-feed detection member detected the double feed of the sheets and the aforementioned transfer speed. Further, the double-feed length of a sheet refers to a length of a portion of the sheet which is laid over or under another sheet in the transfer direction.

The control member refers to a microcomputer for controlling at least the sheet-length detection member, the transfer-length detection member and the double-feed detection member and, also, may be a microcomputer for overall controlling the sheet feeder including a reading member, an image forming member and the like, as will be described later.

For example, the control member may be a member which comprises a CPU, a ROM which stores control programs, a RAM which stores various types of set conditions, I/O ports connected to various types of sensors, a driver circuit which drives various types of driving members for the transfer roller and the like, on the basis of outputs from the CPU.

In view of an another aspect of the present invention, there is provided an automated document feeder and reader, which comprises: a sheet feeder for feeding sheets to a predetermined reading portion; and an image reader for reading images on the sheets transferred by the sheet feeder at the predetermined reading portion; wherein the sheet feeder comprises the aforementioned sheet feeder according to the present invention.

Further, in view of a different aspect of the present invention, there is provided a copying machine, which comprises: an automated document feeder and reader; and an image forming member for forming images on sheets, the images being read by the automated document feeder and reader; wherein the automated document feeder and reader comprises the aforementioned automated document feeder and reader according to the present invention.

In the aforementioned copying machine according to the present invention, the control member may stop transferring of the sheets when it is determined that double feed of the sheets has occurred until an tip end of the sheet reaches the reading portion, and may successively output read images to the image forming member before a rear end of the sheet passes through the read portion when it is determined that no double feed of the sheets has occurred.

With the aforementioned configuration, when it is determined that double feed of the sheets has occurred until the tip end of the sheet reaches the reading portion, the transferring of the sheets is stopped, but when it is determined that no double feed of the sheets has occurred, read images are successively outputted to the image forming member, without waiting for the passage of the rear end of the sheet through the reading portion.

Accordingly, where the transfer length is smaller than the transfer path length, it is possible to prevent the sheets from reaching to the reading portion while being overlapped with one another, and to prevent improper image formation due to double feed of the sheets, while enabling successively outputting read images to the image forming member for increasing the speed of image formation.

Further, in the aforementioned configuration, it is possible to employ an expanded sheet length which is the sheet length detected by the sheet-length detection member plus a predetermined length, instead of the aforementioned transfer length, so that a comparison is made between the expanded sheet length and the transfer path length to determine whether the transfer length is greater or smaller than the transfer path length.

Further, in this case, the aforementioned transfer path length refers to a shorter length, out of a distance from the transfer-length detection member to the reading portion and a distance from the double-feed length detection member to the reading portion.

In the aforementioned copying machine according to the present invention, the control member may stop transferring of the sheets and also may stop outputting of read images to the image forming member when it is determined that double feed of the sheets has occurred until the rear end of the sheet passes through the reading portion, and the control member may successively output read images to the image forming member after the rear end of the sheet passes through the reading portion when it is determined that no double feed of the sheets has occurred.

With the aforementioned configuration, when it is determined that double feed of the sheets has occurred until the rear end of the sheet passes through the reading portion, the transferring of the sheets is stopped and also the outputting of read images to the image forming member is stopped, but when it is determined that no double feed of the sheets has occurred, read images are successively outputted to the image forming member after the rear end of the sheet passes through the reading portion.

Accordingly, where the transfer length is greater than the transfer path length, it is possible to prevent images read at a double-feed state from being directly outputted to the image forming member, which enables prevention of improper image formation due to double feed of the sheets.

Further, in the aforementioned configuration, it is possible to employ an expanded sheet length which is the sheet length detected by the sheet-length detection member plus a predetermined length, instead of the aforementioned transfer length, so that a comparison is made between the expanded sheet length and the transfer path length to determine whether the transfer length is greater or smaller than the transfer path length.

Further, in this case, the aforementioned transfer path length refers to a shorter length out of a distance from the transfer-length detection member to the reading portion and a distance from the double-feed length detection member to the reading portion.

In the aforementioned copying machine, the control member may make a comparison between an expanded sheet length which is the sheet length plus a predetermined length and a transfer path length which is a shorter length out of a length from the transfer-length detection member to the reading portion and a length from the double-feed length detection member to the reading portion. In a case where the expanded sheet length is smaller than the transfer path length, the control member may stop transferring of the sheets when it is determined that double feed of the sheets has occurred, and may successively output read images to the image forming member before a rear end of the sheet passes through the read portion when it is determined that no double feed of the sheets has occurred. In a case where the expanded sheet length is greater than the transfer path length, the control member may stop transferring of the sheets and also may stop outputting of read images to the image forming member when it is determined that double feed of the sheets has occurred, and the control member may successively output read images to the image forming member after the rear end of the sheet passes through the reading portion when it is determined that no double feed of the sheets has occurred.

With the aforementioned configuration, the comparison is made between the expanded sheet length which is the sheet length plus a predetermined length and the transfer path length which is the shorter length out of the length from the transfer-length detection member to the reading portion and the length from the double-feed detection member to the reading portion, in order to previously determine whether or not double feed of the sheets can be detected until the tip end of the sheet reaches the reading portion. And then, output timing of the read images is varied in dependence on whether double feed can be detected until the tip end of the sheet reaches the reading portion. Thus, regardless of the length of the transfer path, improper image formation due to double feed of the sheets is certainly prevented.

Hereinafter, the present invention will be described in detail, on the basis of an embodiment illustrated in the drawings.

Preferred Embodiment

With reference to FIGS. 1 to 11, there will be described an automated document feeder (a sheet feeder) (hereinafter, referred to as an "ADF") according to an embodiment of the present invention. FIG. 1 is a schematic view illustrating an entire structure of a copying machine incorporating the ADF according to the embodiment.

Entire Configuration and Operation of the Copying Machine

As shown in FIG. 1, a copying machine 100 incorporating an ADF 1 according to the embodiment of the present invention forms monochrome images on predetermined recording sheets (sheets), according to image data obtained by scanning documents transferred by the ADF 1 or image data transmitted from the outside.

The image forming device 100 mainly comprises the ADF 1, an image reading unit 2, an optical writing unit 3 as an image forming member, a developer 4, a photosensitive member 5, a electric charger 6, a cleaner unit 7, a transfer unit 8, a fixing unit 9, a sheet transfer path 10, sheet supply trays 11 and a sheet discharging tray 12.

The image reading unit 2 mainly comprises a light source holder 13, a mirror group 14 and a CCD 15.

In the case where a document transferred by the ADF 1, an image of the document is scanned in the state in which the light source holder 13 and the mirror group 14 are stationary.

When a document is transferred by the ADF 1, a light source in the light source holder 13 irradiates the document with a light beam. The optical path of the light beam reflected on the document is changed via the mirror group 14, so that the image is focused on the CCD 15, which then converts the light beam into electronic image data.

Incidentally, specific structure and operation of the ADF 1 will be described later.

The electric charger 6 is electrically charging means for uniformly charging a surface of the photosensitive member 5 at a predetermined electric potential. Although the electric charger 6 of a charger type is used in the copying machine 100 in the preferred embodiment, an electric charging roller or a brush of a contact type may also be used.

In addition, although the optical writing unit 3 consists of a laser scanning unit (abbreviated as "LSU") provided with laser irradiators 16*a* and 16*b* and mirrors 17*a* and 17*b*, an EL writing head or an LED writing head having light emitting elements arrayed thereon may also be used.

The optical writing unit 3 adopts a 2-beam system including the two laser irradiators 16*a* and 16*b* in order to cope with high-speed printing, and therefore, it is possible to reduce a burden accompanied with the higher speed of irradiation timing.

The laser irradiators 16*a* and 16*b* irradiate the light beams in accordance with the input image data, and then, expose the photosensitive member 5, which has been uniformly charged by the electric charger 6, by the light beams via the mirrors 17*a* and 17*b*, thus an electrostatic latent image is formed on the photosensitive member 5 in accordance with the image data.

The developer 4 disposed in the vicinity of the photosensitive member 5 is adapted to develop the electrostatic latent image formed on the photosensitive member 5 with a black toner.

Furthermore, the cleaner unit 7 disposed around the photosensitive member 5 is designed to remove and recycle a toner remaining on the photosensitive member 5 after the image is developed and transferred.

The copying machine 100 includes a controller, not shown, for comprehensively controlling the entirety.

The controller is constituted of a CPU, a ROM which stores therein a control program to be executed by the CPU, a RAM which provides the CPU with a work area, a non-volatile memory which holds control data therein, an input circuit which receives a signal from each of detectors in the copying machine 100, a driver circuit which drives an actuator or a motor for actuating each of drive mechanisms in the copying machine 100, an output circuit which drives the laser irradiators 16*a* and 16*b*, and the like.

As described above, the electrostatic image developed on the photosensitive member 5 is transferred onto a recording sheet by applying an electric field having a polarity reverse to that of an electric charge of the electrostatic image from the transfer unit 8 to the recording sheet being fed.

In the case where the electrostatic image has an electric charge of, for example, a minus polarity, a polarity applied by the transfer unit 8 is plus.

A transfer belt 19 in the transfer unit 8 is stretched around a driving roller 20, a driven roller 21 and other rollers, and has a predetermined resistance value (for example, in the range of $1\times10^{9}$ to $1\times10^{13}$ Ω·cm).

An elastic and conductive roller 22 disposed at a contact portion between the photosensitive member 5 and the transfer belt 19 has conductivity and being capable of applying a transfer electric field thereto.

The electrostatic image with a not-fixed toner, which has been transferred onto the recording sheet by the transfer unit 8, is transferred to the fixing unit 9, in which the not-fixed toner is fused and fixed onto the recording sheet.

The fixing unit 9 includes a heating roller 23 and a pressurizing roller 24. The heating roller 23 incorporates, at the inner circumference thereof, a heat source which heat the surface of the heating roller 23 up to a predetermined temperature (fixing temperature: about 160 to 200° C.).

On the other hand, the pressurizing roller 24 includes pressurizing members, not shown, at both ends thereof in such a manner so as to be brought into press-contact with the heating roller 23 under a predetermined pressure.

In this manner, the not-fixed toner on the recording sheet being transferred thereto is heated and fused by the heating roller 23 at a press-contact portion, which is called a fixing-nipping portion, between the heating roller 23 and the pressurizing roller 24, and then, is fixed onto the recording sheet by an osmotic function at the press-contact portion.

The plural sheet supplying trays 11 are adapted to stack thereon the recording sheets for use in image formation, and are housed under in the copying machine 100 in the preferred embodiment.

Since the copying machine 100 in the preferred embodiment directs the high-speed printing, each of the sheet supplying trays 11 secures a capacity capable of stacking thereon 500 to 1500 pieces of recording sheets of a standardized size.

Moreover, a large capacity sheet supplying cassette (abbreviated as "LCC") 25 capable of stacking thereon a great quantity of recording sheets of a plurality of types and a manual feeding tray 26 for use mainly in printing for a sheet of an irregular size are installed at a side surface of the copying machine 100.

The sheet discharging tray 12 is disposed at a side surface opposite to manual feeding tray 26. In place of the sheet discharging tray 12, a post-processor for a discharged sheet such as a stapler or a puncher or sheet discharging trays on a plurality of stages may be optionally installed.

Configuration and Operations of ADF

Figure 2:
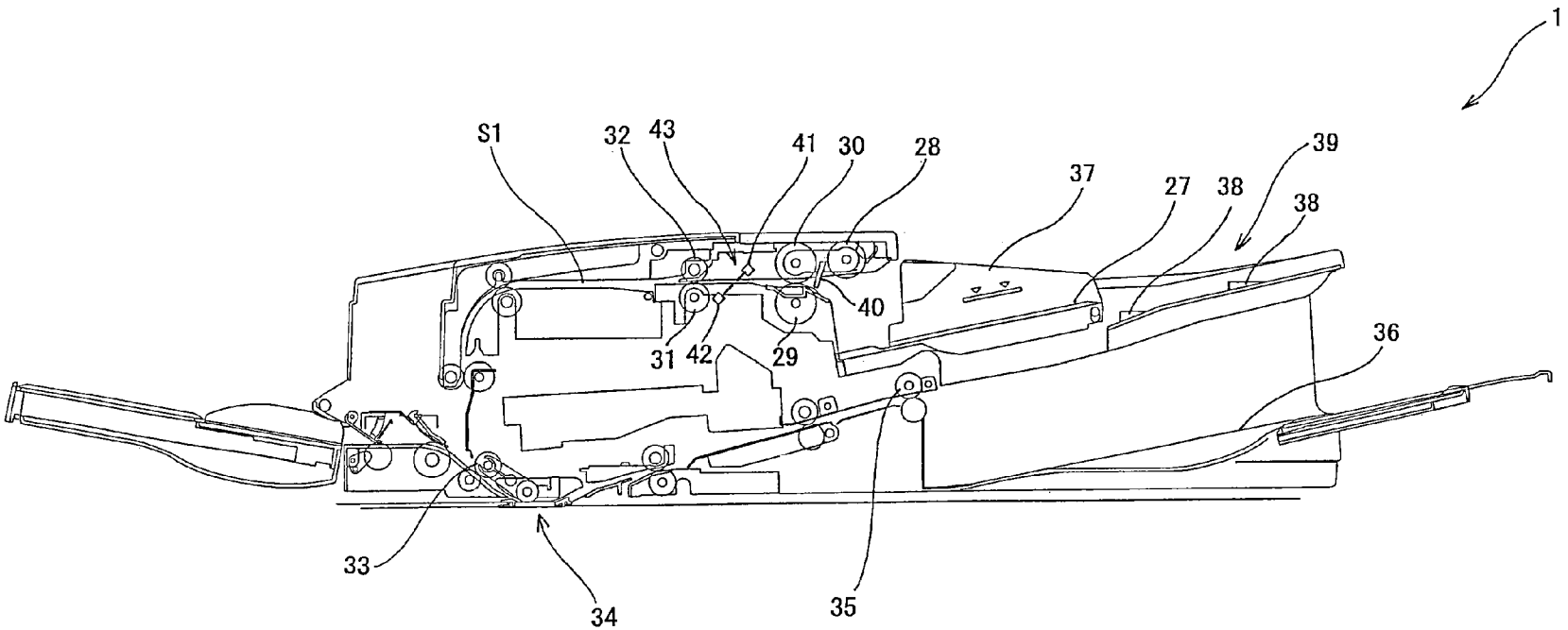
FIG. 2 is a schematic view schematically illustrating the structure of the ADF according to the embodiment.
Figure 3:
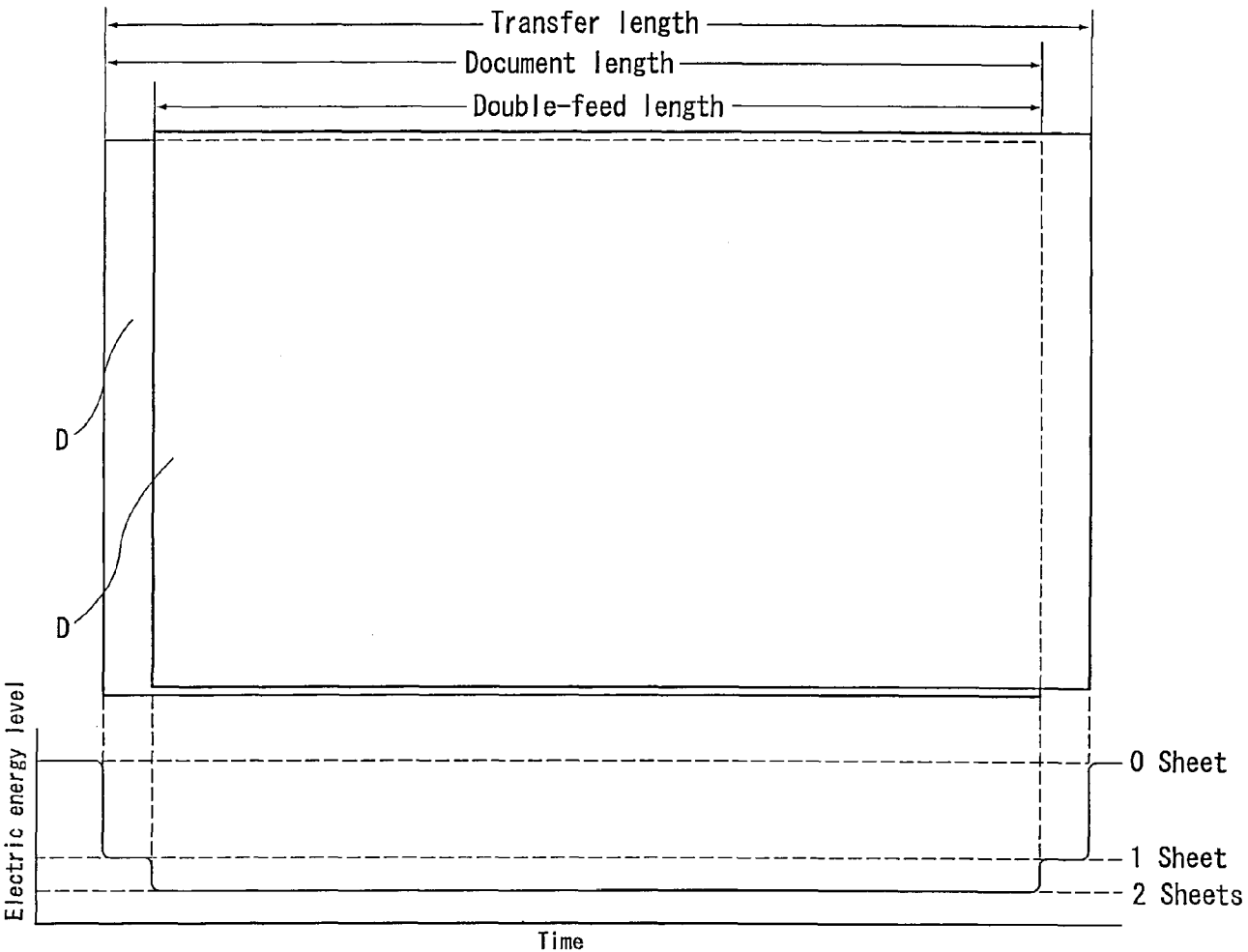
FIG. 3 is an explanatory view for explaining partial reduction of level of electric energy resulted from conversion by a wave receiver in a double-feed detection sensor, in a case where double feed of documents occurs.
Figure 4:
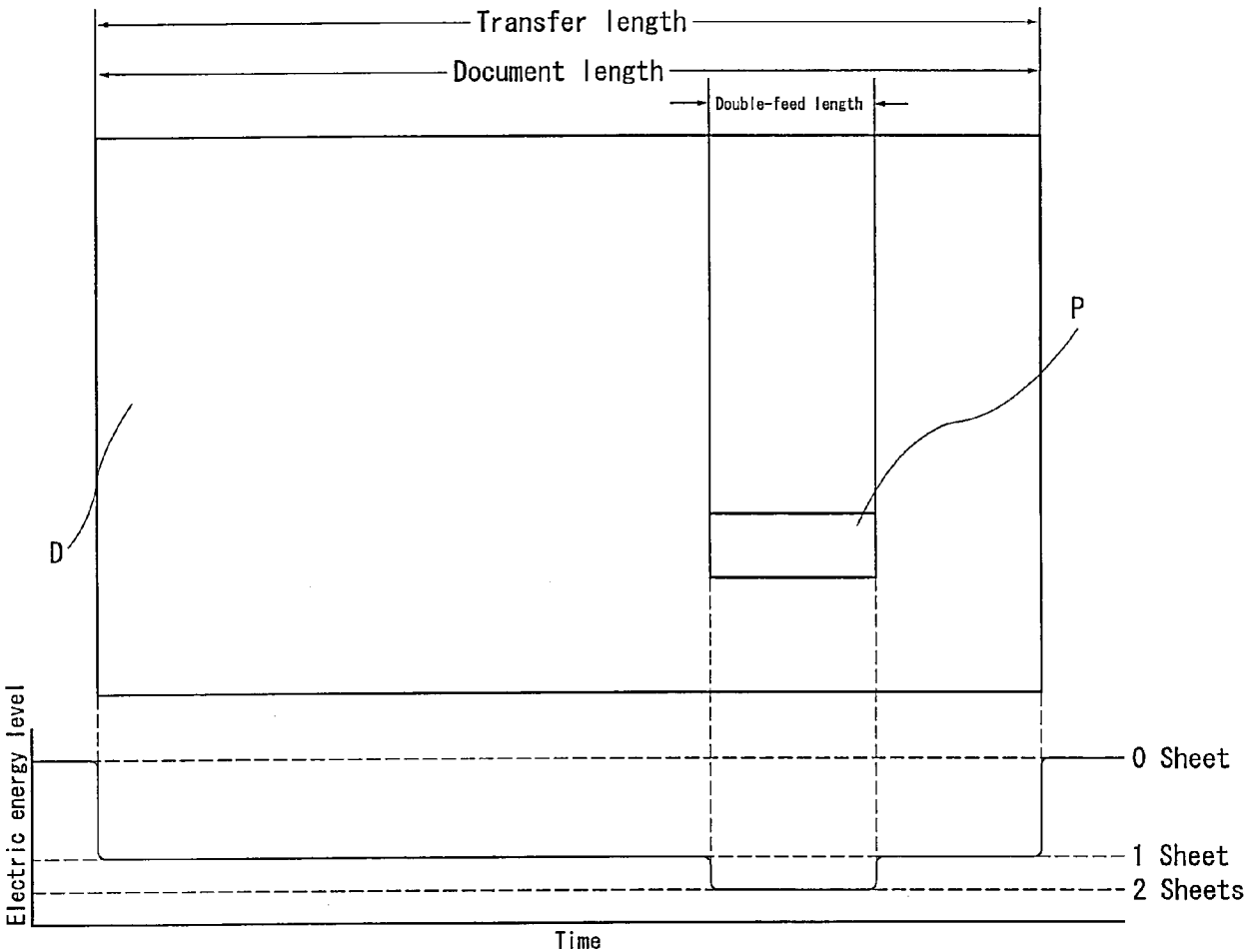
FIG. 4 is an explanatory view for explaining the partial reduction of the level of electric energy resulted from conversion by the wave receiver in the double-feed detection sensor, in a case where a label is attached to a document.
Figure 5:
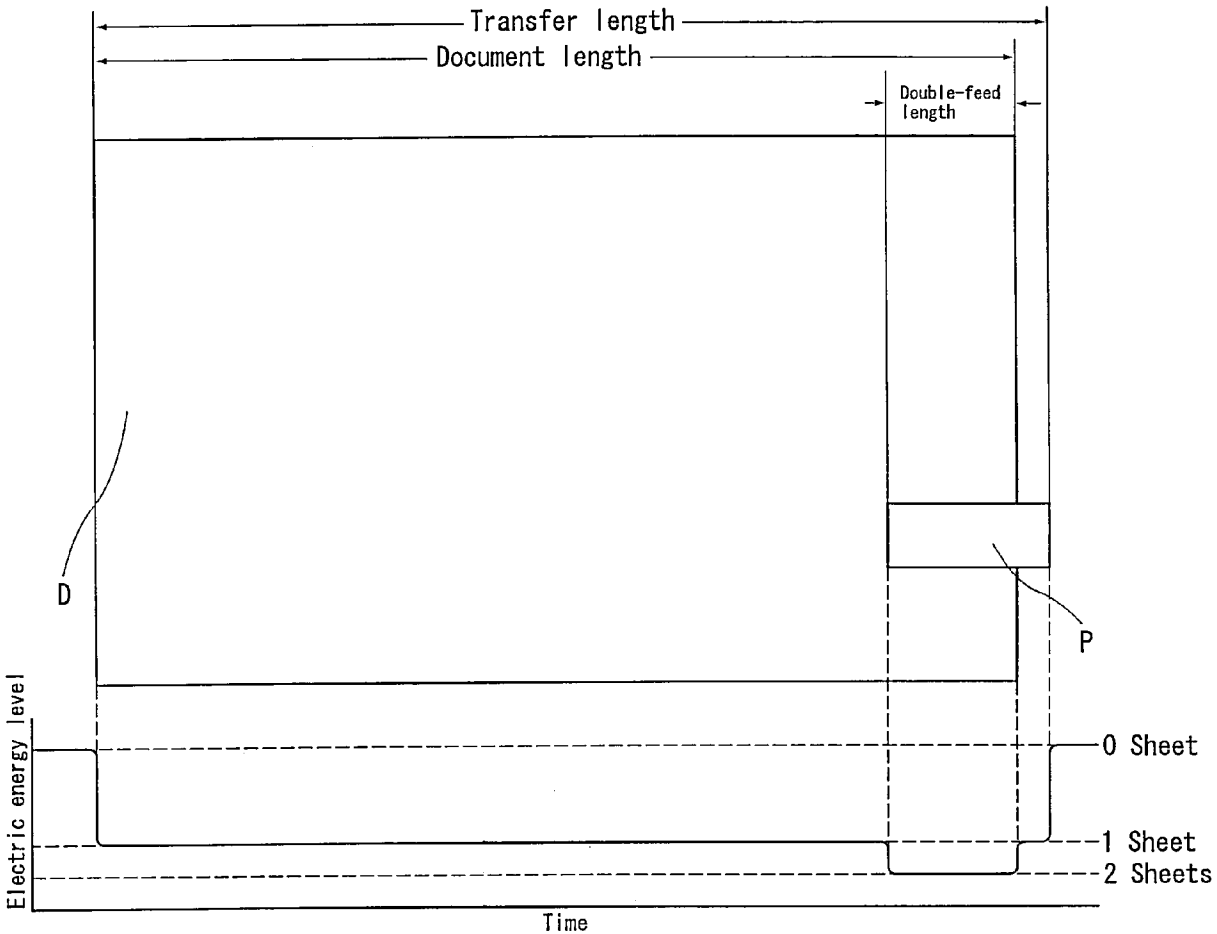
FIG. 5 is an explanatory view for explaining the partial reduction of the level of electric energy resulted from conversion by the wave receiver in the double-feed detection sensor, in a case where a label is attached to a document.
Figure 6:
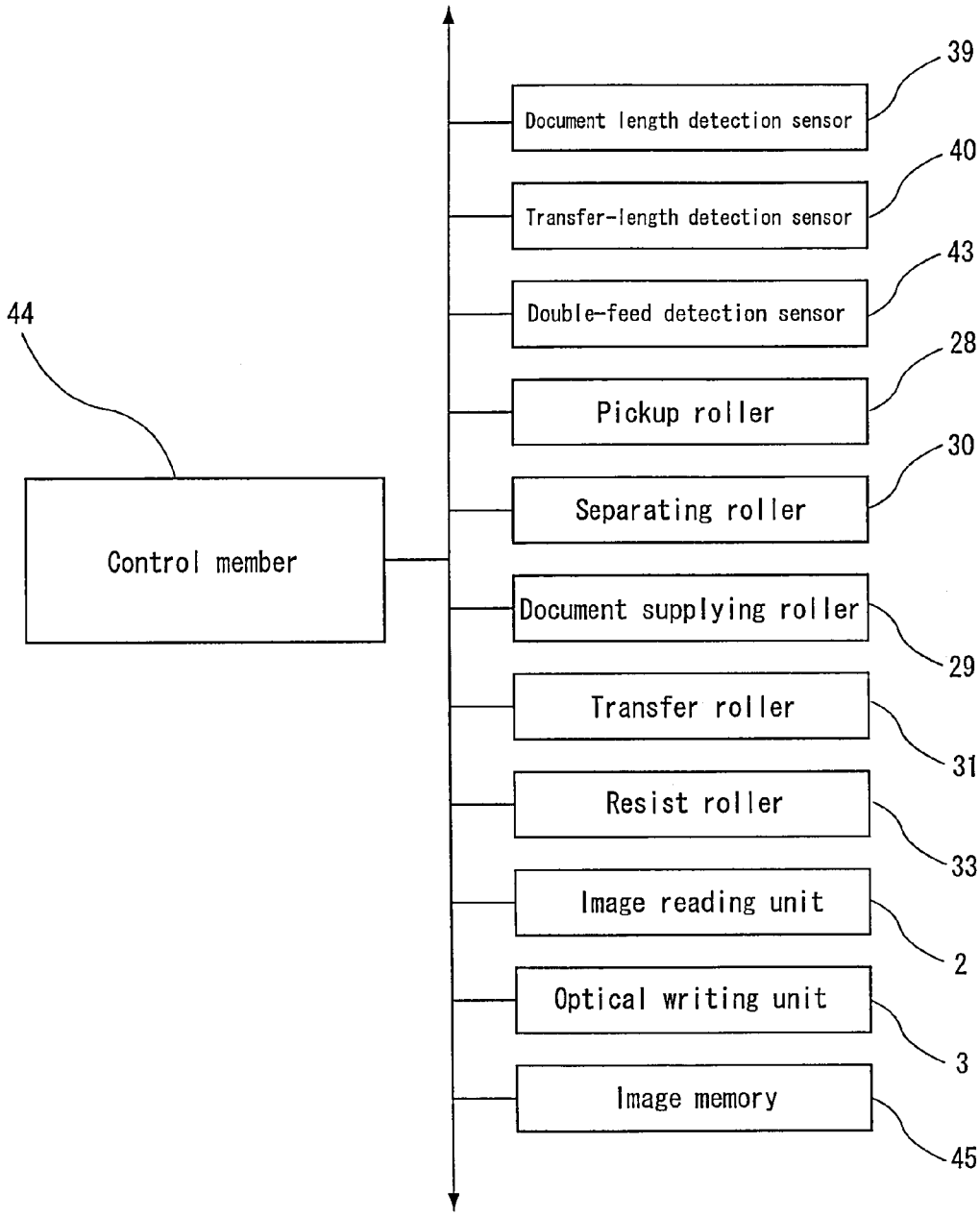
FIG. 6 is a block diagram illustrating relationship between the control member and various types of sensors.

The ADF 1 incorporated in the aforementioned copying machine 100 will be described on the basis of FIGS. 2 to 11. FIG. 2 is a schematic view schematically illustrating the structure of the ADF according to the embodiment. FIG. 3 is an explanatory view for explaining the partial reduction of the level of electric energy resulted from conversion by a wave receiver in a double-feed detection sensor, in a case where double feed of documents occurs. FIG. 4 and FIG. 5 are explanatory views for explaining the partial reduction of the level of electric energy resulted from conversion by the wave receiver in the double-feed detection sensor, in a case where a label is attached to a document. FIG. 6 is a block diagram illustrating the relationship between the control member and various types of sensors. FIGS. 7 to 16 are flowcharts illustrating a series of control flows conducted by the control member in detecting double feed of documents.

As shown in FIG. 2, the ADF 1 incorporated in the aforementioned copying machine 100 (see FIG. 1) includes a document-length detection sensor (sheet-length detection member) 39 for detecting a length of a document, a transfer-length detection sensor (transfer-length detection member) 40 for detecting a transfer length of a document, a double-feed detection sensor (double-feed detection member) 43 for detecting double feed of documents when documents are transferred while being overlapped with each other, and a control member 44 for controlling the document-length detection sensor 39, the transfer-length detection sensor 40 and the double-feed detection sensor 43 (see FIG. 5). The control member 44 is configured to determine that double feed of a document has occurred, where the transfer length of the document is greater than the length of the document and, also, a length obtained by subtracting the difference between the transfer length of the document and the length of the document from the length of the document is substantially equal to the double-feed length detected by the double-feed detection sensor 43.

More specifically, as shown in FIG. 2, the ADF 1 is mainly constituted by a document tray 27 on which a stack of documents mounted, a pickup roller 28 for feeding documents, one by one, to a document transfer path S1 from the stack of documents mounted on the document tray 27, a pair of a document supplying roller 29 and a separating roller 30 for transferring the documents downstream of the document transfer path S1 while separating the documents one from another, plural pairs of a transfer roller 31 and a driven roller 32 provided along the document transfer path S1, a resist roller 33 for temporarily holding the documents transferred thereto and then transferring the documents to a reading portion 34 at predetermined timing, and a document discharging roller 35 for discharging the document whose image had been read onto a document discharging tray 36.

The document tray 27 in the ADF 1 is provided with a pair of movable restriction plates 37 which can be adjusted to the width of the stack of documents mounted thereon in the direction of main scanning (the direction orthogonal to the transfer direction), and plural document detection sensors 38 protruded from the document tray 27 along the direction of the transfer of documents. The pair of restriction plates 37 function as a document width sensor since they can be adjusted to the width of documents and, also, function as a document-length detection sensor 39 in cooperation with the document detection sensor 38, as well as restricting the width of the stack of documents.

The pair of restriction plates 37, which can be adjusted to the width of documents, enable detection of the width of the documents in the direction of main scanning. Further, on the basis of the presence or absence of reactions of the plural document detection sensors 38, a standardized size which matches with the size of the documents placed on the document tray 27 is selected out of pre-stored plural types of standardized sizes. This enables detection of the length of the documents (the length of the documents in the transfer direction).

Further, as shown in FIG. 2, between the pickup roller 28 and the separating roller 30 in the ADF 1, there is provided a mechanical sheet passage sensor including a pin which displaces if it comes into contact with a document being transferred therethrough, as the transfer-length detection sensor 40.

The pin in the transfer-length detection sensor 40 is displaced by the tip of a document being passed therethrough and then is restored to the original position after the rear end of the document is passed therethrough. Accordingly, by measuring the time period since the occurrence of displacement of the pin until the restoration of the pin to the original position, it is possible to detect the time period taken for passing the document through the transfer-length detection sensor 40.

The rotation speed of the pickup roller 28 is preliminarily set to a constant rotation speed and, therefore, the document transfer speed is also caused to be a predetermined speed, naturally. Therefore, the actual transfer length of the document can be determined, from the product of the document passage time period and the document transfer speed.

Further, as shown in FIG. 2, between the document supplying roller 29 and the separating roller 30 and the transfer roller 31 and the driven roller 32 along the document transfer path S1, there is provided the double-feed detection sensor 43 for detecting double feed of documents when documents are transferred while being overlapped with each other.

The double-feed detection sensor 43 comprises a wave generator 41 which generates an ultrasonic wave, and a wave receiver 42 which receives the ultrasonic wave generated from the wave generator 41 and passed through documents while being attenuated thereby.

As shown in FIG. 3, in a case where double feed of documents D occurs, the ultrasonic wave generated from the wave generator 41 is largely attenuated at the portion of the double feed, therefore the level of electric energy converted by the wave receiver 42 has a value as indicated at a lower part of FIG. 3.

Similarly, as shown in FIG. 4, in a case where a label P is attached to a document D, the ultrasonic wave generated from the wave generator 41 is largely attenuated at the portion of the document D at which the label P is attached, therefore the level of electric energy converted by the wave receiver 42 has a value as indicated at a lower part of FIG. 4.

Further, as shown in FIG. 5, in a case where a label P is attached to a document D such that the label P is protruded from the outer edge of the document D, the ultrasonic wave generated from the wave generator 41 is largely attenuated within the area of the document D at which the label P is attached, therefore the level of electric energy converted by the wave receiver 42 has a value as indicated at a lower part of FIG. 5.

In this case, the time period during which the level of the electric energy is reduced to below a predetermined threshold value (a level corresponding to a single sheet) is regarded as the time period during which double feed is detected. From the product of this time period and the transfer speed for documents D, it is possible to determine the double-feed length, namely the length of the overlap between the documents D or the length of the overlap between the document D and the label P, in the transfer direction.

As shown in FIG. 6, the control member 44 is connected to the document-length detection sensor 39, the transfer-length detection sensor 40, the double-feed detection sensor 43, the pickup roller 28, the separating roller 30, the document supplying roller 29, the transfer roller 31, the resist roller 33, the image reading unit 2, the optical writing unit 3, and respective portions of the copying machine 100, such as an image memory 45. Thus, the control member 44 controls them comprehensively.

Figure 7:
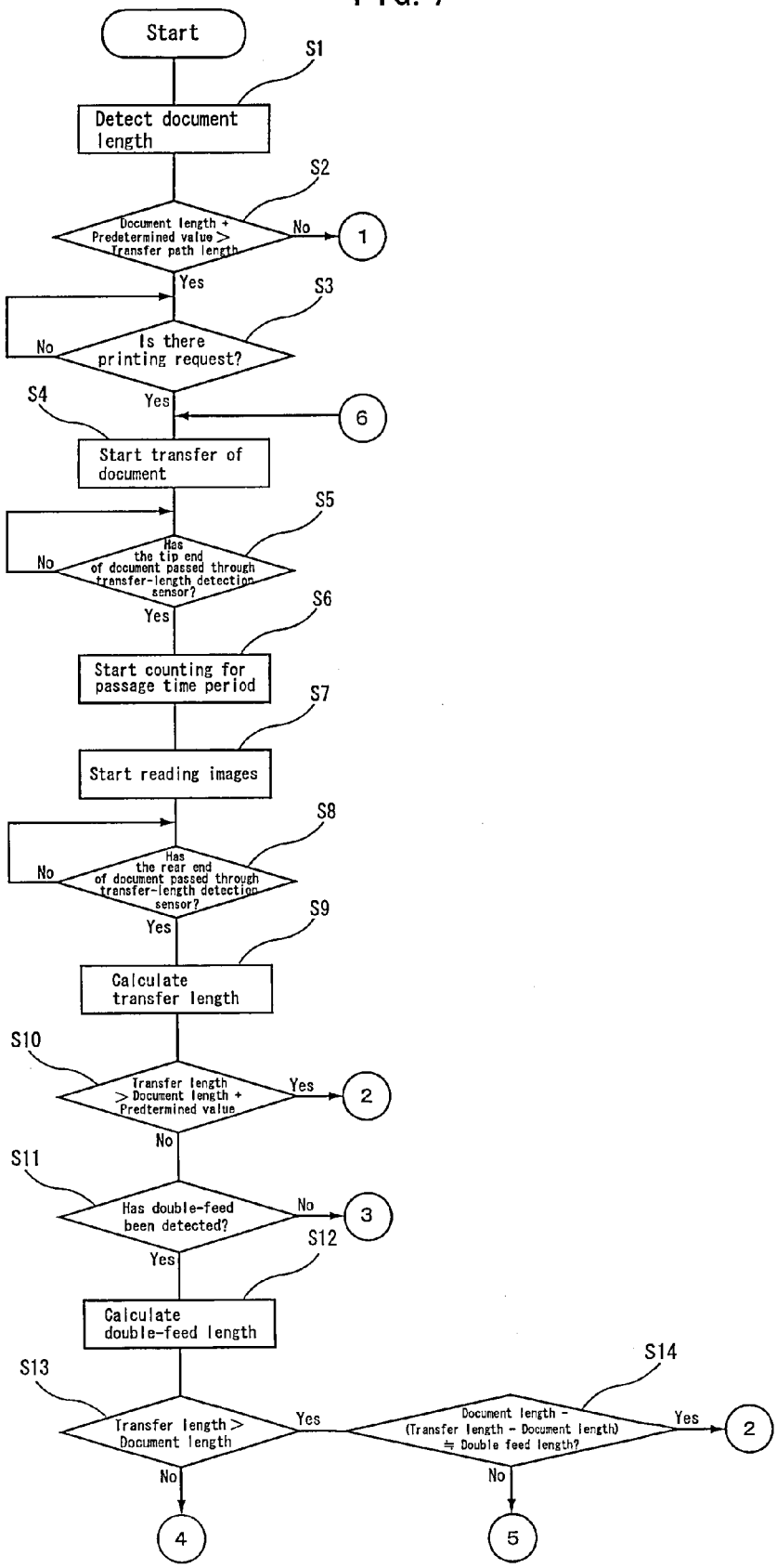
FIG. 7 is a flowchart illustrating a continuous control flow conducted by a control member in detecting double feed of documents.

When a stack of documents is mounted on the document tray 27 of the ADF 1 shown in FIG. 2, as shown in FIG. 7, on the basis of information acquired from the aforementioned document-length detection sensor 39, the control member 44 selects a standardized size which matches with the aforementioned information, out of pre-stored plural types of standardized sizes, and detects the length of the documents (step S1).

After the detection of the length of the documents at the step 1, the control member 44 proceeds to a step 2 where it determines whether or not an expanded sheet length which is the detected document length plus a predetermined value (for example, 100 mm) is greater than the transfer path length.

In this case, "the transfer path length" refers to the length of the shorter distance, out of the distance from the position at which the transfer-length detection sensor 40 is placed to the reading portion 34 along the document transfer path S1 and the distance from the position at which the double-feed detection sensor 43 is placed to the reading portion 34 along the document transfer path S1.

If it is determined at the step 2 that the expanded sheet length is greater than the transfer path length, the control member 44 proceeds to a step 3 where it determines whether or not a printing request has been made to the copying machine 100.

If the control member 44 determines at the step 3 that a printing request has been made, the control member 44 proceeds to a step 4 where it drives the pickup roller 28 to feed documents, one by one, out of the stack of documents, from the uppermost document thereof, into the document transfer path S1, and then starts transferring of documents.

After starting the transferring of documents at the step 4, the control member 44 proceeds to a step 5 where it determines whether or not the tip of a document has been passed through the transfer-length detection sensor 40.

If it is determined at the step 5 that the tip of a document is passed through the transfer-length detection sensor 40, the control member 44 proceeds to a step 6 where it starts measuring, through counting, the time period during which the document is passed through the transfer-length detection sensor 40.

After the start of counting for the time period during which the document is passed, the control member 44 proceeds to a step 7 where it controls and drives the resist roller 33 to transfer the document to the reading portion 43 at predetermined timing, then starts reading images on the document and stores the read images as electronic data in the image memory 45.

After starting reading images on the document at the step S7, the control member 44 proceeds to a step 8 where it determines whether or not the rear end of the document has been passed through the transfer-length detection sensor 40.

If it is determined at the step 8 that the rear end of the document has been passed through the transfer-length detection sensor 40, the control member 44 proceeds to a step 9 where it stops counting for the passage time period taken to pass the document through the transfer-length detection sensor 40 and calculates the transfer length of the document along the document transfer path S1, from the product of the passage time period determined through counting and the document transfer speed calculated from the rotation speed of the pickup roller 28.

After the calculation of the transfer length of the document at the step 9, the control member 44 proceeds to a step 10 where it determines whether or not the transfer length of the document is greater than an expanded sheet length which is the document length plus a predetermined value.

Figure 11:
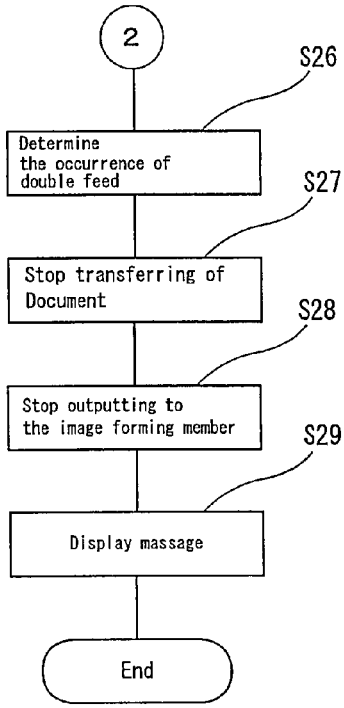
FIG. 11 is a flowchart illustrating the continuous control flow conducted by the control member in detecting double feed of documents.

If it is determined at the step 10 that the transfer length of the document is greater than the expanded sheet length, the control member 44 proceeds to a step 26 illustrated in FIG. 11 where the control member 44 determines that double feed of the document has occurred and then stops the transfer of the document (step 27) and, then, the control member 44 stops outputting the image data stored in the image memory 45 to the optical writing unit (image forming member) 3 in the copying machine 100 (step 28), displays a massage indicative of the occurrence of double feed of the document on a display panel (not illustrated) in the ADF 1 (step 29) and then ends the continuous flow.

On the other hand, if it is determined at the step 10 that the transfer length of the document is not greater than the expanded sheet length, the control member 44 proceeds to a step 11 where it determines whether or not the double-feed detection sensor 43 has detected double feed of the document. More specifically, as described above, the control member 44 determines whether or not the level of electric energy converted by the wave receiver 42 was reduced to below a predetermined threshold value (a level corresponding to a single sheet).

Figure 8:
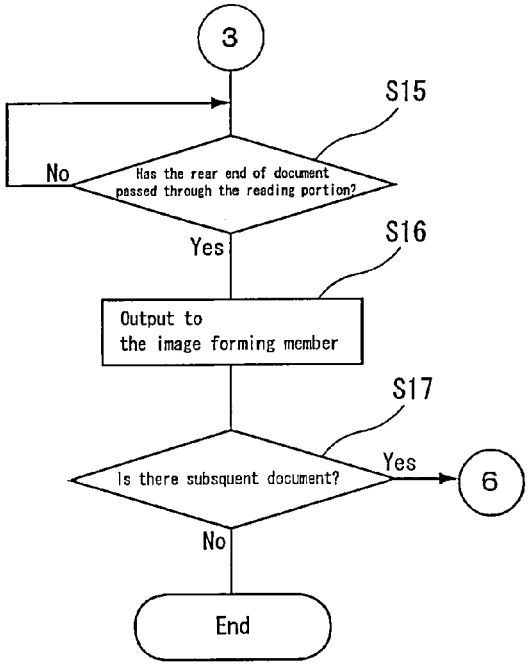
FIG. 8 is a flowchart illustrating the continuous control flow conducted by the control member in detecting double feed of documents.

If double feed of the document is not detected at the step 11, the control member 44 proceeds to a step 15 where it determines whether or not the rear end of the document has passed through the reading portion 34, as shown in FIG. 8.

If it is determined at the step 15 that the rear end of the document has passed through the reading portion 34, the control member 44 proceeds to a step 16 where the control member 44 outputs image data stored in the image memory 45 to the optical writing unit (image forming member) 3 in the copying machine 100 and, then, the control member 44 determines whether or not there is a document to be read subsequently (step 17). If the control member 44 determines that there is a subsequent document, the process returns to the step 4 where the control member 44 starts transfer of a document. If the control member 44 determines that there is no subsequent document, it ends the continuous flow.

On the other hand, if double feed is detected at the aforementioned step 11 shown in FIG. 7, the control member 44 proceeds to a step 12 where it determines, through counting, the time period during which the level of the electric energy converted by the wave receiver 42 in the double-feed detection sensor 43 is reduced to below the predetermined threshold value, and calculates the double-feed length of the document from the product of this time period and the document transfer speed.

After calculating the double-feed length of the document at the step 12, the process proceeds to a step 13 where the control member 44 determines whether or not the transfer length of the document is greater than the length of the document.

Figure 9:
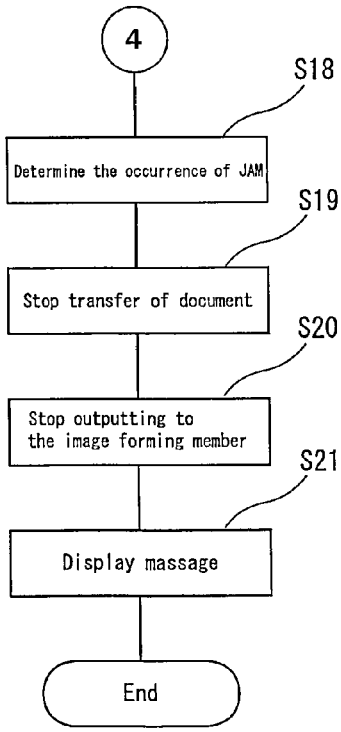
FIG. 9 is a flowchart illustrating the continuous control flow conducted by the control member in detecting double feed of documents.

If it is determined at the step 13 that the transfer length of the document is not greater than the length of the document, the control member 44 proceeds to a step 18 shown in FIG. 9 where the control member 44 determines that a document jam (JAM) has occurred and, then, the control member 44 stops the transferring of the document (step 19), stops outputting the image data stored in the image memory 45 to the optical writing unit (image forming member) 3 in the copying machine 100 (step 20), displays a massage indicative of the occurrence of a document jam on the display panel (not illustrated) in the ADF 1 (step 21) and ends the continuous flow.

On the other hand, if it is determined at the aforementioned step 13 shown in FIG. 7 that the transfer length of the document is greater than the length of the document, the control member 44 proceeds to a step 14 where it determines whether or not the length obtained by subtracting a difference between the transfer length and the length of the document from the length of the document is substantially equal to the double-feed length.

Figure 10:
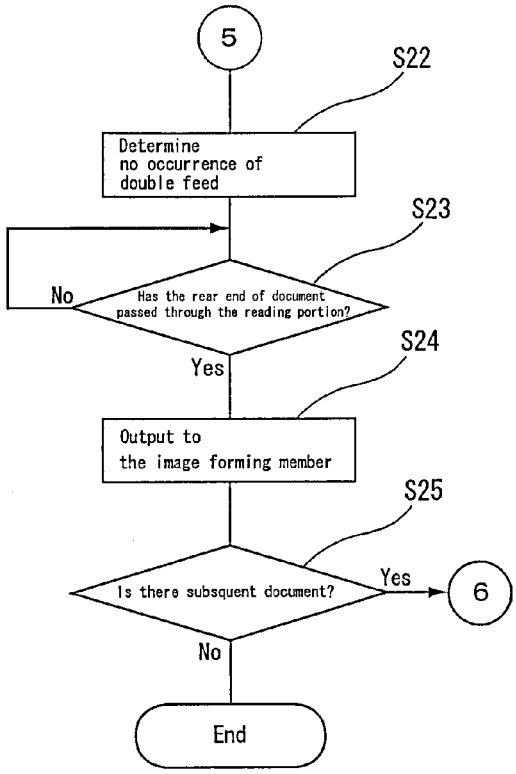
FIG. 10 is a flowchart illustrating the continuous control flow conducted by the control member in detecting double feed of documents.

If it is determined at the step 14 that the length obtained by subtracting the difference between the transfer length and the length of the document from the length of the document is not substantially equal to the double-feed length, the control member 44 proceeds to a step 22 where it determines that no double feed of the document has occurred, as shown in FIG. 10 and, then, the control member 44 proceeds to a step 23 where it determines whether or not the rear end of the document has passed through the reading portion 43.

If it is determined at the step 23 that the rear end of the document has passed through the reading portion 34, the control member 44 proceeds to a step 24 where it outputs the image data stored in the image memory 45 to the optical writing unit (image forming member) 3 in the copying machine 100 and, then, the control member 44 determines whether or not there is a document to be read subsequently (step 25). If the control member 44 determines that there is a document to be read subsequently, the control member 44 returns to the step 4 where it starts transferring the document. If the control member 44 determines that there is no document to be read subsequently, the control member 44 ends the continuous flow.

On the other hand, if it is determined at the aforementioned step 14 shown in FIG. 7 that the length obtained by subtracting the difference between the transfer length and the length of the document from the length of the document is substantially equal to the double-feed length, the control member 44 proceeds to the aforementioned step 26 shown in FIG. 11 where it determines that double feed of the document has occurred and, then, the control member 44 stops the transferring of the document (step 27), stops outputting the image data stored in the image memory 45 to the optical writing unit (image forming member) 3 in the copying machine 100 (step 28), displays a massage indicative of the occurrence of double feed of the document on the display panel (not illustrated) of the ADF 1 (step 29) and then ends the continuous flow.

Figure 12:
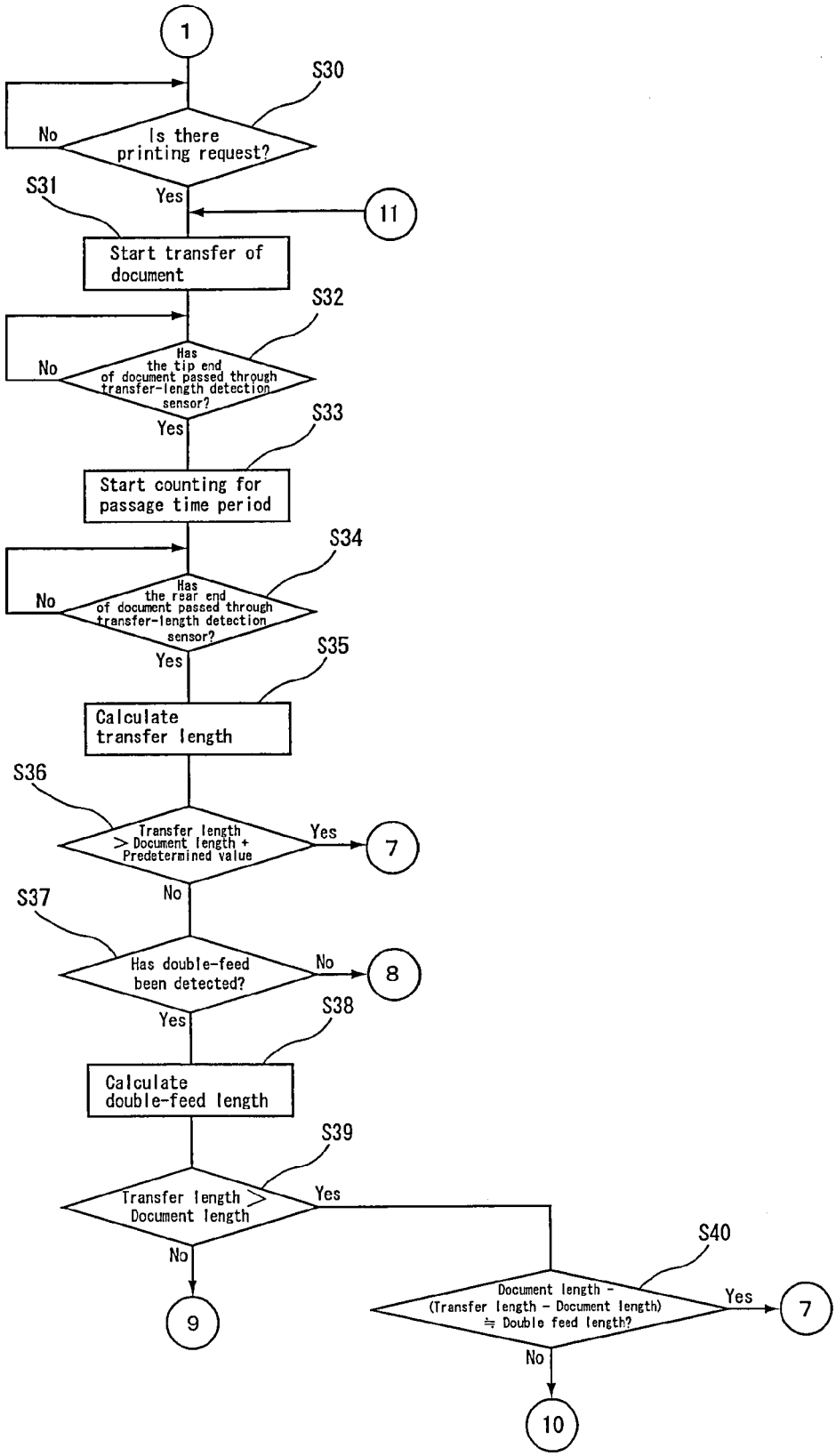
FIG. 12 is a flowchart illustrating the continuous control flow conducted by the control member in detecting double feed of documents.

Further, if it is determined at the step 2 illustrated in FIG. 7 that the expanded sheet length which is the length of the document plus the predetermined value is not greater than the transfer path length, the control member 44 proceeds to a step 30 shown in FIG. 12 where the control member 44 determines whether or not a printing request has been made to the copying machine 100.

If it is determined at the step 30 that a printing request has been made, the control member 44 proceeds to a step 31 where it drives the pickup roller 28 to feed documents, one by one, out of the stack of documents, from the uppermost document, into the document transfer path S1, and starts transferring documents.

After starting the transfer of the document, the control member 44 proceeds to a step 32 where it determines whether or not the tip end of the document has passed through the transfer-length detection sensor 40.

If it is determined at the step 32 that the tip end of the document has passed through the transfer-length detection sensor 40, the control member 44 proceeds to a step 33 where it starts counting for the time period during which the document passes through the transfer-length detection sensor 40.

After starting the counting for the document passage time period at the step 33, the control member 44 proceeds to a step 34 where it determines whether or not the rear end of the document has passed through the transfer-length detection sensor 40.

If it is determined at the step 34 that the rear end of the document has passed through the transfer-length detection sensor 40, the control member 44 proceeds to a step 35 where it stops the counting for the passage time period taken to pass the document through the transfer-length detection sensor 40 and, then, calculates the transfer length of the document along the document transfer path S1, from the product of the passage time period determined through counting and the document transfer speed calculated from the rotation speed of the pickup roller 28.

After the calculation of the transfer length of the document at the step 35, the control member 44 proceeds to a step 36 where it determines whether or not the transfer length of the document is greater than an expanded sheet length which is the length of the document plus a predetermined value.

Figure 16:
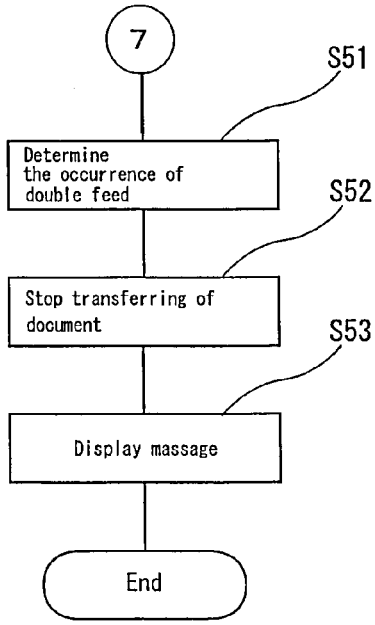
FIG. 16 is a flowchart illustrating the continuous control flow conducted by the control member in detecting double feed of documents.

If it is determined at the step 36 that the transfer length of the document is greater than the expanded sheet length, the control member 44 proceeds to a step 51 shown in FIG. 16 where the control member 44 determines that double feed of the document has occurred and, then, the control member 44 stops the transfer of the document (step 52), displays a massage indicative of the occurrence of double feed of the document on the display panel (not illustrated) in the ADF 1 (step 53) and then ends the continuous flow.

On the other hand, if it is determined at the step 36 illustrated in FIG. 12 that the transfer length of the document is not greater than the expanded sheet length, the control member 44 proceeds to a step 37 where it determines whether or not the double-feed detection sensor 43 has detected double feed of the document.

Figure 13:
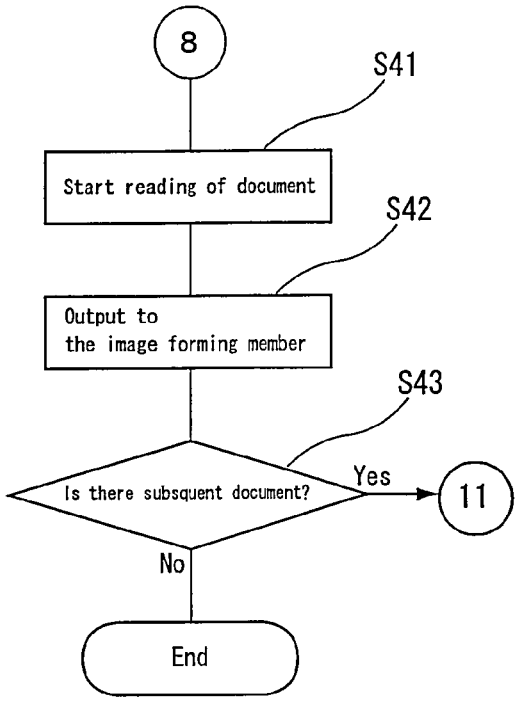
FIG. 13 is a flowchart illustrating the continuous control flow conducted by the control member in detecting double feed of documents.

If no double feed of the document has been detected at the step 37, the control member 44 proceeds to a step 41 where it drives and controls the resist roller 33 to transfer the document to the reading portion 34 at predetermined timing and starts reading images on the document and, then, the control member 44 proceeds to a step 42 where it successively outputs the read images to the optical writing unit (image forming member) 3 in the copying machine 100, as shown in FIG. 13.

Thereafter, the control member 44 proceeds to a step 43 where it determines whether or not there is a document to be read subsequently. If the control member 44 determines that there is a document to be read subsequently, the control portion 44 returns to the step 31 where it starts transferring the document. If the control member 44 determines that there is no subsequent document, it ends the continuous flow.

On the other hand, if double feed of the document is detected at the aforementioned step 37 shown in FIG. 12, the control member 44 proceeds to a step 38 where it measures, through counting, the time period during which the level of the electric energy converted by the wave receiver 42 in the double-feed detection sensor 43 is reduced to below the predetermined threshold value, and calculates the double-feed length of the document from the product of this time period and the document transfer speed.

After the calculation of the double-feed length of the document at the step 38, the control member 44 proceeds to a step 39 where it determines whether or not the transfer length of the document is greater than the length of the document.

Figure 14:
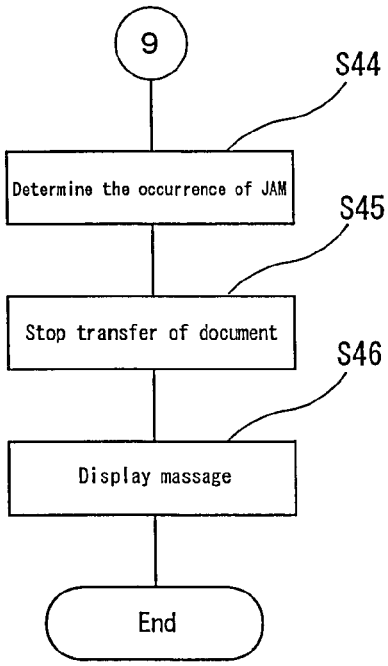
FIG. 14 is a flowchart illustrating the continuous control flow conducted by the control member in detecting double feed of documents.

If it is determined at the step 39 that the transfer length of the document is not greater than the length of the document, the control member 44 proceeds to a step 44 shown in FIG. 14 where it determines that a document jam (JAM) has occurred and, then, the control member 44 stops the transferring of the document (step 45), displays a massage indicative of the occurrence of a document jam on the display panel (not illustrated) in the ADF 1 (step 46) and ends the continuous flow.

On the other hand, if it is determined at the aforementioned step 39 illustrated in FIG. 12 that the transfer length of the document is greater than the length of the document, the control member 44 proceeds to a step 40 where it determines whether or not the length obtained by subtracting the difference between the transfer length and the document length from the document length is substantially equal to the double-feed length.

Figure 15:
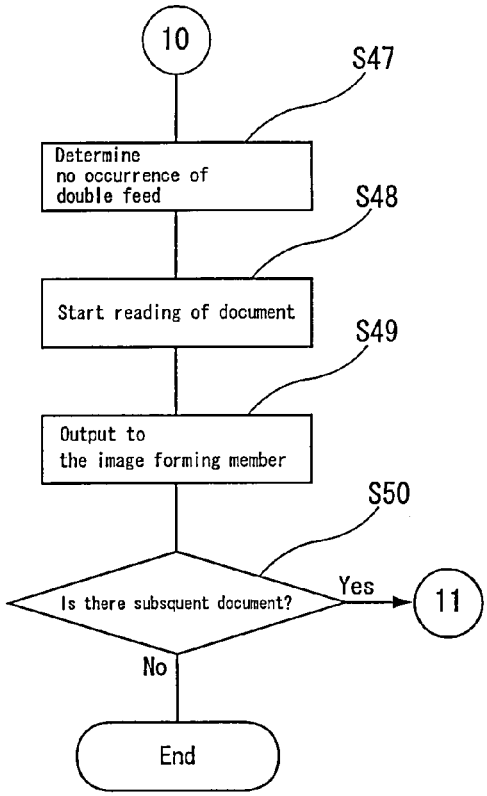
FIG. 15 is a flowchart illustrating the continuous control flow conducted by the control member in detecting double feed of documents.

If it is determined at the step 40 that the length obtained by subtracting the difference between the transfer length and the document length from the document length is not substantially equal to the double-feed length, the control member 44 proceeds to a step 47 where it determines that no double feed of the document has occurred, then the control member 44 drives and controls the resist roller 33 to transfer the document to the reading portion 34 at predetermined timing and then starts reading images on the document (step 48) and, then, the control member 44 proceeds to a step 49 where it successively outputs the read image data to the optical writing unit (image forming member) 3 in the copying machine 100, as shown in FIG. 15.

Thereafter, the control member 44 proceeds to a step 50 where it determines whether or not there is a document to be read subsequently. If the control member 44 determines that there is a subsequent document, the control member 44 returns to the step 31 where it starts transferring the document. If the control member 44 determines that there is no subsequent document, it ends the continuous flow.

On the other hand, if it is determined at the aforementioned step 40 shown in FIG. 12 that the length obtained by subtracting the difference between the transfer length and the document length from the document length is substantially equal to the double-feed length, the control member 44 proceeds to the aforementioned step 51 shown in FIG. 16 where it determines that double feed of the document has occurred, then the control member 44 stops the transferring of the document (step 52), displays a massage indicative of the occurrence of double feed of the document on the display panel (not illustrated) of the ADF 1 (step 53) and then ends the continuous flow.

Namely, according to the aforementioned control method, the occurrence of double feed of a document is detected, only if the transfer length is greater than the length of the document and, also, the length obtained by subtracting the difference between the transfer length and the length of the document from the length of the document is substantially equal to the length of the double feed.

Accordingly, only states where documents D are overlapped with each other as shown in FIG. 3 are determined to be double feed, while states where a label P is merely attached to a document D as shown in FIG. 4 and FIG. 5 are not determined to be double feed.

Consequently, even if a stack of documents contains a document on which a label is attached, it is possible to prevent it from being falsely detected as double feed.

Further, a comparison is made between the shorter length, out of the length from the transfer-length detection sensor 40 to the reading portion 34 and the length from the double-feed detection sensor 43 to the reading portion 34, namely the transfer path length, and an expanded sheet length which is the length of a document plus a predetermined value to determine preliminarily whether or not double feed of the document D can be detected until the tip end of the document D reaches the reading portion 34. And then, output timing of the read images is varied in dependence on whether double feed can be detected until the tip end of the document D reaches the reading portion 34. Thus, regardless of the length of the transfer path, improper image formation due to double feed of the documents D is certainly prevented.

Further, the aforementioned embodiment has been described, on the premise that documents D have standardized sizes. However, even in a case where documents D do not have standardized sizes, it is also possible to detect the document length of the document D having non-standardized size, by detecting the tip end of the document D with the transfer-length detection sensor 40 and further detecting the rear end of the document D with the double-feed detection sensor 43.

What is claimed is:

1. A sheet feeder comprising:

a sheet-length detection member for detecting a length of a sheet;

a transfer-length detection member for detecting a transfer length of the sheet;

a double-feed detection member for detecting double feed of the sheets when the sheets are transferred while being overlapped with one another; and a control member for controlling the sheet-length detection member, the transfer-length detection member and the double-feed detection member;

wherein the control member determines that double feed of the sheets has occurred, when the transfer length of the sheet is greater than the length of the sheet and a length obtained by subtracting a difference between the transfer length of the sheet and the length of the sheet from the length of the sheet is substantially equal to a double-feed length detected by the double-feed detection member.

2. An automated document feeder and reader comprising:

a sheet feeder for feeding sheets to a predetermined reading portion; and an image reader for reading images on the sheets transferred by the sheet feeder at the predetermined reading portion;

wherein the sheet feeder comprises the sheet feeder as set forth in claim 1.

3. A copying machine comprising:

an automated document feeder and reader; and an image forming member for forming images on sheets, the images being read by the automated document feeder and reader;

wherein the automated document feeder and reader comprises the automated document feeder and reader as set forth in claim 2.

4. The copying machine as set forth in claim 3, wherein prior to a tip end of the sheet reaching the reading portion, the control member stops transferring of the sheets when the control member determines that double feed of the sheets has occurred, and the control member successively output read images to the image forming member before a rear end of the sheet passes through the read portion when the control member determines that no double feed of the sheets has occurred.

5. The copying machine as set forth in claim 3, wherein prior to a rear end of the sheet passing through the reading portion, the control member stops transferring of the sheets and also stops outputting of the read images to the image forming member when the control member determines that double feed of the sheets has occurred and the control member successively output read images to the image forming member after the rear end of the sheet passes through the reading portion when the control member determines that no double feed of the sheets has occurred.

6. The copying machine as set forth in claim 3, wherein the control member makes a comparison between an expanded sheet length and a transfer path length, the expanded sheet length being the sheet length plus a predetermined length, the transfer path length being a shorter length out of a length from the transfer-length detection member to the reading portion and a length from the double-feed detection member to the reading portion, in a case where the expanded sheet length is smaller than the transfer path length, the control member stops transferring of the sheets when the control member determines that double feed of the sheets has occurred, and the control member successively outputs read images to the image forming member before a rear end of the sheet passes through the read portion when the control member determines that no double feed of the sheets has occurred, in a case where the expanded sheet length is greater than the transfer path length, the control member stops transferring of the sheets and also stops outputting of read images to the image forming member when the control member determines that double feed of the sheets has occurred, and the control member successively outputs read images to the image forming member after the rear end of the sheet passes through the reading portion when the control member determines that no double feed of the sheets has occurred.

* * * * *